US009744505B2

(12) United States Patent
Knauer

(10) Patent No.: US 9,744,505 B2
(45) **Date of Patent: *Aug. 29, 2017**

(54) STIRRER

(71) Applicant: Ecolab USA Inc., Saint Paul, MN (US)

(72) Inventor: Jochen Friedrich Knauer, Bad Homburg (DE)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/840,799

(22) Filed: Aug. 31, 2015

(65) Prior Publication Data

US 2015/0367299 A1 Dec. 24, 2015

Related U.S. Application Data

(63) Continuation of application No. 13/821,604, filed as application No. PCT/EP2011/065491 on Sep. 7, 2011, now Pat. No. 9,120,063.

(30) Foreign Application Priority Data

Sep. 10, 2010 (DE) ..... 10 2010 037 473

(51) Int. Cl.
*B01F 7/00* (2006.01)
*B01F 7/22* (2006.01)
(Continued)

(52) U.S. Cl.
CPC ..... *B01F 7/22* (2013.01); *B01F 3/04539* (2013.01); *B01F 7/007* (2013.01);
(Continued)

(58) Field of Classification Search
CPC ..... B01F 7/007
(Continued)

(56) References Cited

U.S. PATENT DOCUMENTS 332,349 A * 12/1885 Knox ..... B01F 7/088 366/321
684,295 A * 10/1901 McLellan ..... B01F 7/048 366/303

(Continued)

FOREIGN PATENT DOCUMENTS

| | | | |
|---|---|---|---|
| EP | 1479758 | A2 | 11/2004 |
| SU | 1454367 | A1 | 1/1989 |
| WO | 2012032090 | A1 | 3/2012 |

OTHER PUBLICATIONS

International Search Report and Written Opinion for PCT/EP2011/065491, issued Mar. 12, 2013.

*Primary Examiner* — David Sorkin
(74) *Attorney, Agent, or Firm* — Fredrikson & Byron, P.A.

(57) ABSTRACT

A stirrer having a motor; a hollow shaft that is drivable via the motor and is provided with at least one additive outlet opening, via which an additive passed through the hollow shaft can be discharged; and a rotor arranged on the hollow shaft and having rotor blades, characterized in that a second rotor having rotor blades is provided on the hollow shaft at a distance from the first rotor, and in that the at least one additive outlet opening is provided between the two rotors, wherein the rotors are designed and drivable such that, during operation, a negative pressure and a centrifugal force are generated in the intermediate space defined between the rotors.

13 Claims, 3 Drawing Sheets

(51) Int. Cl.
*B01F 3/04* (2006.01)
*B01F 7/16* (2006.01)

(52) U.S. Cl.
CPC ..... *B01F 7/00316* (2013.01); *B01F 7/00341* (2013.01); *B01F 7/00633* (2013.01); *B01F 7/1625* (2013.01); *B01F 2003/04546* (2013.01); *B01F 2003/04695* (2013.01); *B01F 2003/04865* (2013.01); *B01F 2215/0003* (2013.01); *B01F 2215/0052* (2013.01)

(58) Field of Classification Search
USPC ..... 366/169.2, 321; 261/87
See application file for complete search history.

(56) References Cited

U.S. PATENT DOCUMENTS

| | | | | |
|---|---|---|---|---|
| 975,380 | A | 11/1910 | Berntson | |
| 1,242,445 | A | 10/1917 | Ittner | |
| 2,203,673 | A | 6/1940 | Cornell | |
| 2,404,679 | A | 7/1946 | Andron et al. | |
| 2,928,661 | A | 3/1960 | MacLaren | |
| 3,400,918 | A | 9/1968 | MacLaren | |
| 3,776,531 | A | 12/1973 | Ebner et al. | |
| 5,478,535 | A | 12/1995 | Fierz et al. | |
| 6,158,722 | A | 12/2000 | Gigas et al. | |
| 9,120,063 | B2 * | 9/2015 | Knauer | B01F 3/04539 |
| 2006/0176771 | A1 * | 8/2006 | Adams | B01F 7/00633 366/270 |

* cited by examiner

STIRRER

RELATED APPLICATIONS

This application is a continuation of and claims the benefit of priority to U.S. application Ser. No. 13/821,604, filed Apr. 30, 2013, which is a 35 U.S.C. §371 U.S. National Stage of International Application No. PCT/EP2011/065491, filed Sep. 7, 2011, which claims the benefit of priority to German Application No. DE 10 2010 037 473.3, filed Sep. 10, 2010. The entire content of each of the aforementioned patent applications is incorporated herein by reference.

BACKGROUND OF THE INVENTION

Such stirrers are known in a wide variety of configurations in the prior art and are used in different technical fields. For example, DE-A-25 11 717 discloses a stirrer having a motor-operated hollow shaft and a rotor fastened thereto. The rotor is provided with holes or additive outlet openings, via which an additive in the form of air passed through the hollow shaft can be introduced into a liquid to be treated in order to aerate it, as is required for example in the treatment of biological slurry. DE-U-93 06 907 describes a liquid manure aeration device having a rotor driven via a hollow shaft, wherein additives in the form of air or chemicals can be drawn in by the hollow shaft simply under the effect of the negative pressure generated by the rotor and can be admixed via a corresponding additive outlet opening provided in the lower region of the hollow shaft. However, in the case of the known stirrers, both the intermixing of the medium to be treated and the feeding of the additive to be admixed are capable of improvement.

SUMMARY OF THE INVENTION

The present invention relates to a stirrer having a motor, a hollow shaft that is drivable via the motor and is provided with at least one additive outlet opening, through which an additive passed through the hollow shaft can be discharged, and a rotor arranged on the hollow shaft and having rotor blades.

It is an object of the present invention to create a stirrer of the type mentioned at the beginning, which has a simple structure and ensures very good intermixing of the medium to be treated and proper feeding of the additive to be admixed.

In order to achieve this object, the present invention provides a stirrer of the type mentioned at the beginning, which is characterized in that a second rotor having rotor blades is provided on the hollow shaft at a distance from the first rotor, and in that the at least one additive outlet opening is provided between the two rotors, wherein the rotors are designed and drivable such that, during operation, a negative pressure and a centrifugal force are generated in the intermediate space defined between the rotors.

On account of the fact that during operation of the stirrer a (static) negative pressure is generated in the intermediate space defined between the rotors, the medium to be treated is delivered automatically and continuously from outside into the intermediate space, and as a result very good intermixing is achieved. Furthermore, by virtue of the negative pressure prevailing in the intermediate space and the centrifugal force generated, the additive is sucked continuously and very effectively out of the at least one additive outlet opening, and this leads to very good and constant admixture of the additive. Overall, good intermixing of the medium to be treated and proper introduction of the additive can thus be ensured.

According to one refinement of the present invention, the rotors are connected to the hollow shaft so as to rotate therewith, wherein the rotor blades of the first rotor and the rotor blades of the second rotor are arranged so as to move in opposite directions. In other words, the rotor blades of the first rotor and the rotor blades of the second rotor are inclined in opposite directions. In this way, a very simple structure of the stirrer is achieved. The flow directions of the flows generated by the rotors are preferably directed in opposite directions to one another and/or preferably the suction sides of the rotors, in particular in the axial direction with respect to the hollow shaft, are provided on sides facing away from one another, while the pressure sides of the rotors face one another or are located between the rotors.

Preferably, the rotors are arranged in the region of the free end of the hollow shaft, so that they can be guided very close to the bottom of the particular container in which the medium to be treated is contained.

According to one refinement of the present invention, the hollow shaft and the rotor blades of the first rotor and of the second rotor are produced from plastics material. Accordingly, it is also possible to use the stirrer according to the invention to introduce very aggressive additives into the media to be treated, for example iron(III) chloride ($FeCl_3$), which is used in wastewater treatment for example for phosphate elimination.

Preferably, the at least one additive outlet opening is an elongate cutout which extends in particular in the direction of the hollow shaft axis. By way of such an elongate cutout, it is possible for the additive to be discharged very uniformly.

Advantageously, a plurality of additive outlet openings, which are arranged in a regularly distributed manner along the circumference of the hollow shaft, are provided.

The motor may be an electric motor. The motor can drive the hollow shaft directly. Alternatively, it is of course also possible for a corresponding transmission, for example a bevel gear transmission or the like, to be interposed.

According to one refinement of the present invention, the hollow shaft and the motor are arranged coaxially, wherein an additive feed line is connected in particular to the opposite side of the motor from the hollow shaft. In this way, a very simple structure of the stirrer according to the invention is produced.

The motor may be fastened to a mounting plate, so that the stirrer can be installed without problems.

The details of one or more examples are set forth in the accompanying drawings and the description below. Other features, objects, and advantages will be apparent from the description and drawings, and from the claims.

DETAILED DESCRIPTION

Figure 1:
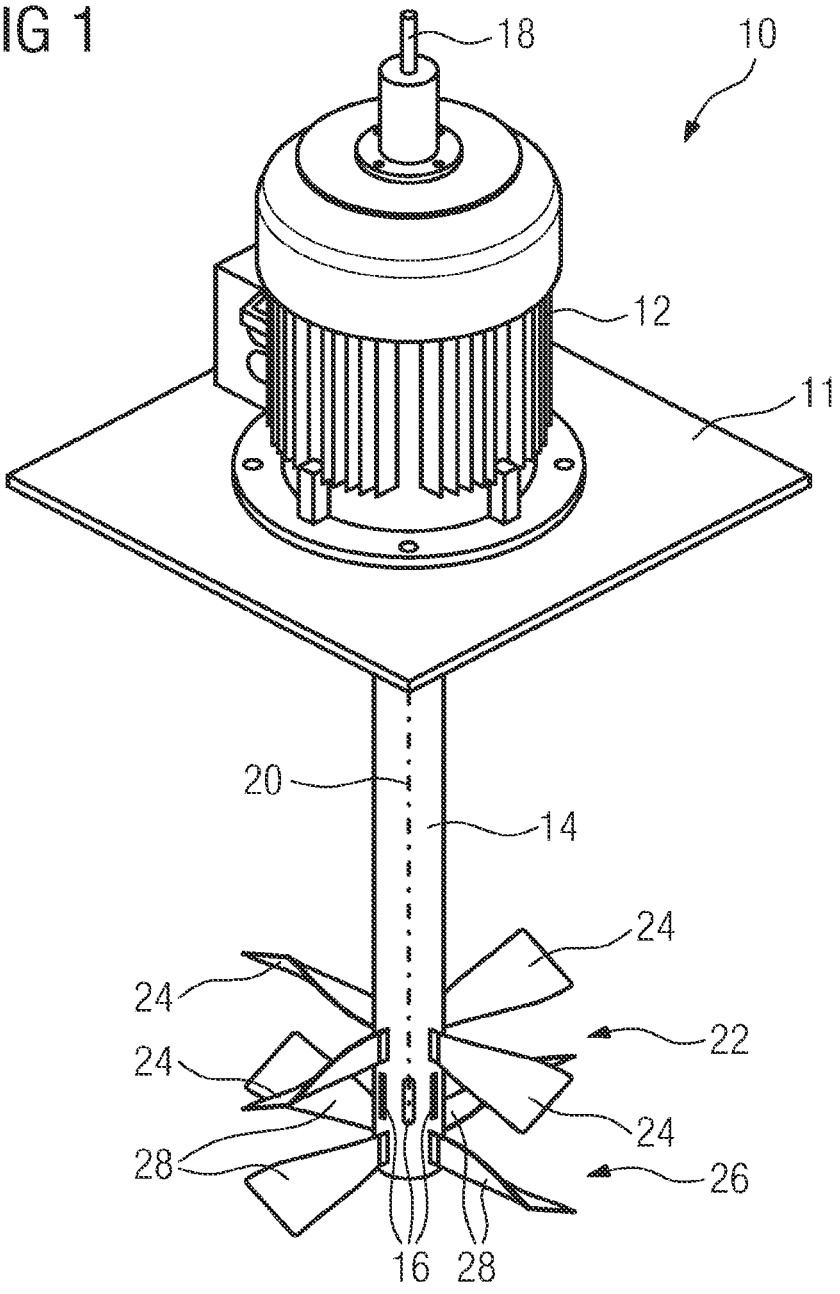
FIG. 1 is a perspective view of a stirrer according to one embodiment of the present invention.
Figure 2:
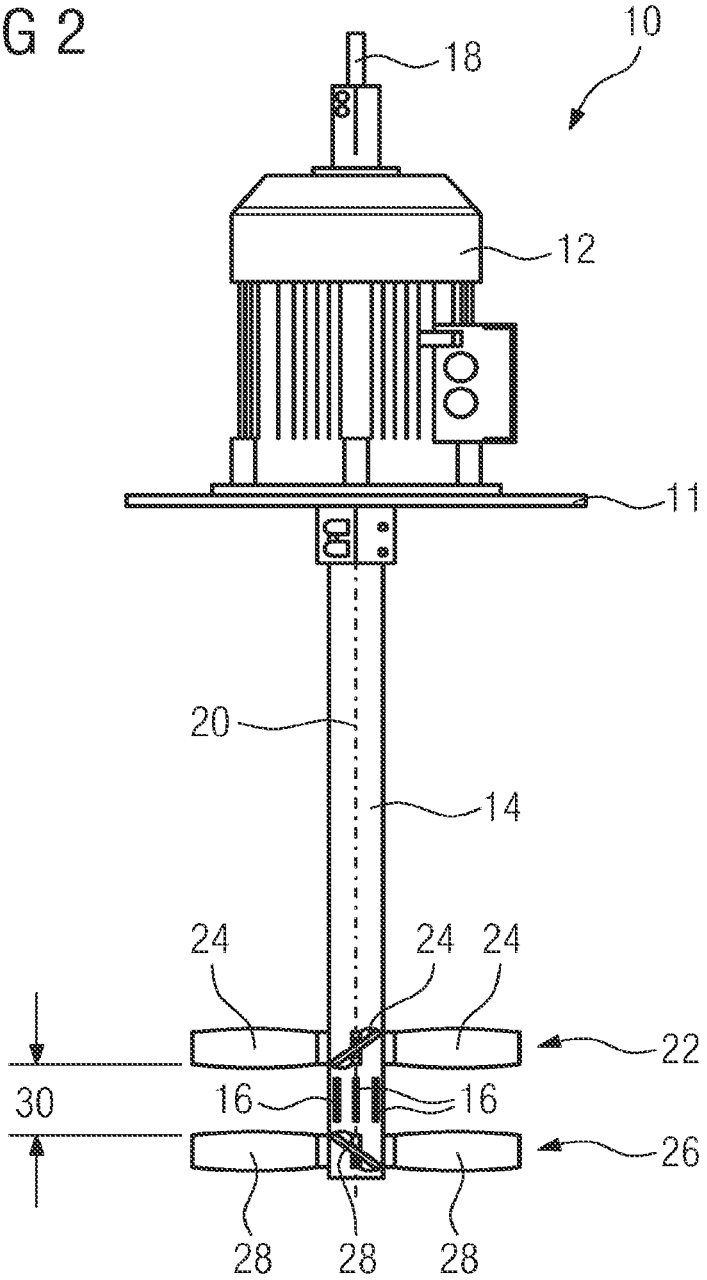
FIG. 2 is a side view of the stirrer illustrated in FIG. 1.
Figure 3:
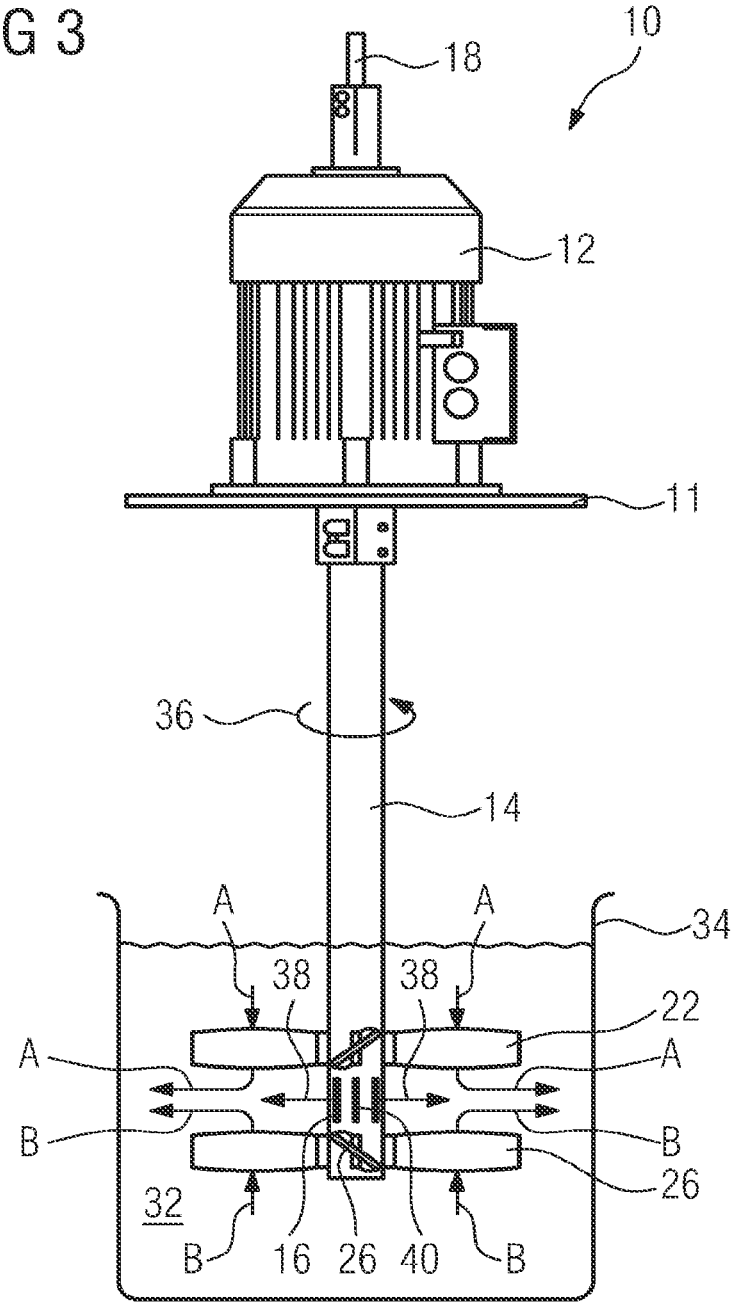
FIG. 3 is a side view of the stirrer illustrated in FIGS. 1 and 2, which has been dipped into a wastewater channel.

FIGS. 1 to 3 show a stirrer 10 according to one embodiment of the present invention. The stirrer 10 comprises an electric motor 12 fastened to a mounting plate 11 and a hollow shaft 14 that is drivable via the motor 12. The hollow shaft 14 is formed entirely from plastics material or from metal material, e.g. a steel, having a coating that is resistant to the additive, in particular a plastics coating. In the region of its free end, the hollow shaft 14 is provided with a multiplicity of additive outlet openings 16. Via these additive outlet openings 16, an additive can be discharged through the hollow shaft 14, said additive being fed via a non-co-rotating feed tube 40 which is guided within the hollow shaft 14, the upper end of said feed tube 40 projecting upwardly as an additive feed line 18 and being attached on the opposite side of the motor 12 from the hollow shaft 14. The end of the feed tube 40 opens out at the level of the additive outlet openings 16. The additive outlet openings 16 are axial elongate cutouts which are arranged in a regularly distributed manner along the circumference of the hollow shaft 14 and extend in each case in the direction of the hollow shaft axis 20.

Furthermore, the stirrer 10 comprises a first rotor 22, which has four rotor blades 24, and also a second rotor 26, which is provided with four rotor blades 28. The rotors 22 and 26, which are produced from plastics material, are connected to the hollow shaft 14 so as to rotate therewith and are arranged at a distance from one another so that they define between one another an intermediate space 30, in which the additive outlet openings 16 are positioned. The rotor blades 24 of the first rotor 22 and the rotor blades 28 of the second rotor 26 are arranged so as to move in opposite directions, that is to say are inclined in opposite directions, so that they generate substantially opposite flows during operation.

The mode of operation of the stirrer 10 is explained in the following text with reference to FIG. 3.

If the free end of the hollow shaft 14 having the rotors 22 and 26 retained thereon is dipped into a wastewater channel 34 filled with wastewater 32, as is illustrated in FIG. 3, and the hollow shaft 14 is then driven with the aid of the motor 12 in the direction of rotation indicated by the arrow 36, the flow A is generated within the wastewater 32 by the first rotor 22 and the flow B is generated by the second rotor 26, as is indicated by the corresponding arrows. In other words, by driving the first rotor 22 wastewater is sucked into the intermediate space 30 from above, while the second rotor 26 sucks or guides wastewater into the intermediate space 30 from below, thereby producing a negative pressure in the intermediate space 30. The wastewater sucked into the intermediate space 30 is then pushed radially outward out of the intermediate space 30, so that a centrifugal force is additionally generated in the intermediate space 30. In this way, good intermixing of the wastewater 32 to be treated is achieved. In addition, the additive fed via the hollow shaft 14 is sucked continuously out of the additive outlet openings 16, as is indicated by the arrows 38, thereby ensuring uniform admixture of the additive.

The additive may be for example iron chloride ($FeCl3$), which is used for phosphate elimination in the wastewater.

The above-described structure of the stirrer 10 is advantageous in particular to the extent that, with a very simple structure, very good intermixing of the medium to be treated and proper introduction of the additive can be ensured.

LIST OF REFERENCE SYMBOLS

10 Stirrer
11 Mounting plate
12 Motor
14 Hollow shaft
16 Additive outlet opening
18 Additive feed line
20 Hollow shaft axis
22 First rotor
24 Rotor blade
26 Second rotor
28 Rotor blade
30 Intermediate space
32 Wastewater
34 Wastewater channel
36 Arrow
38 Arrow
40 Feed tube

The invention claimed is:

1. A stirrer comprising:

a shaft disposed at least partially within a medium;

a first rotor having a first rotor blade and a second rotor blade each attached to the shaft, wherein the first and second rotor blades are spaced apart from one another about a circumference of the shaft so as to define a gap between the first and second rotor blades, and wherein the first rotor is configured when driven to draw the medium from above the first rotor through the gap between the first and second rotor blades;

a second rotor spaced axially along the shaft from the first rotor so as to define an intermediate space between the first and second rotors, the second rotor having a third rotor blade and a fourth rotor blade each attached to the shaft, wherein the third and fourth rotor blades are spaced apart from one another about a circumference of the shaft so as to define a gap between the third and fourth rotor blades, and wherein the second rotor is configured when driven to draw the medium from below the second rotor through the gap between the third and fourth rotor blades; and a first additive outlet opening, defined by the shaft, at the intermediate space between the first and second rotors.

2. The stirrer of claim 1, further comprising a second additive outlet opening defined by the shaft at the intermediate space between the first and second rotors, wherein the second additive outlet opening is spaced from the first additive outlet opening about the circumference of the shaft.

3. The stirrer of claim 1, further comprising:

a motor configured to drive the shaft, wherein the shaft defines a first axial end portion and a second axial end portion opposite the first axial end portion, wherein the motor is coupled to the shaft at or near the first axial end portion and the first, second, third, and fourth rotor blades are attached to the shaft at or near the second axial end portion disposed within the medium, and wherein the first, second, third, and fourth rotor blades extend out from the shaft.

4. The stirrer of claim 3, further comprising:

a feed tube extending within the shaft from the first axial end portion to the second axial end portion, wherein the shaft and feed tube are configured to be non-co-rotating.

5. The stirrer of claim 4, wherein the feed tube terminates in the second axial end portion of the shaft at the first additive outlet opening.

6. The stirrer of claim 1, wherein the first and second rotor blades are attached to the shaft at a first angle in a first direction with respect to the shaft, and wherein the third and fourth rotor blades are attached to the shaft at a second angle in a second direction with respect to the shaft, the second direction being generally opposite the first direction.

7. The stirrer of claim 1, wherein the first additive outlet opening is an elongate cutout extending in a direction of a longitudinal axis of the shaft.

8. A stirrer comprising:

a shaft disposed at least partially within a medium;

a first rotor having a first rotor blade and a second rotor blade each attached to the shaft, wherein the first and second rotor blades are spaced apart from one another about a circumference of the shaft so as to define a gap between the first and second rotor blades, and wherein the first rotor is configured when driven to draw the medium from above the first rotor through the gap between the first and second rotor blades;

a second rotor spaced axially along the shaft from the first rotor so as to define an intermediate space between the first and second rotors, the second rotor having a third rotor blade and a fourth rotor blade each attached to the shaft, wherein the third and fourth rotor blades are spaced apart from one another about a circumference of the shaft so as to define a gap between the third and fourth rotor blades, and wherein the second rotor is configured when driven to draw the medium from below the second rotor through the gap between the third and fourth rotor blades, and wherein the first and second rotors are configured when driven to push the medium radially outward from the intermediate space; and a first outlet located at the intermediate space between the first and second rotors to deliver an additive between the first and second rotors.

9. The stirrer of claim 8, wherein the first outlet is defined by the shaft at the intermediate space between the first and second rotors, and wherein the first and second rotors are configured when driven to draw the additive from the first outlet.

10. The stirrer of claim 9, wherein the first and second rotors are configured when driven to push the medium and the additive radially outward from the intermediate space.

11. The stirrer of claim 9, wherein the first outlet is an elongate cutout extending in a direction of a longitudinal axis of the shaft.

12. The stirrer of claim 8, further comprising a second outlet located at the intermediate space between the first and second rotors, wherein the second outlet is spaced from the first outlet.

13. The stirrer of claim 8, further comprising a feed tube extending within the shaft and terminating at a location of the first outlet, wherein the feed tube and the shaft are configured to be non-co-rotating.

* * * * *